US010450036B2

(12) United States Patent
Killian

(10) Patent No.: US 10,450,036 B2
(45) Date of Patent: Oct. 22, 2019

(54) PORTABLE CANOPY COVER FOR FISHING BOATS

(71) Applicant: Kevin Killian, Pompano Beach, FL (US)

(72) Inventor: Kevin Killian, Pompano Beach, FL (US)

( * ) Notice: Subject to any disclaimer, the term of this patent is extended or adjusted under 35 U.S.C. 154(b) by 0 days.

(21) Appl. No.: 15/682,001

(22) Filed: Aug. 21, 2017

(65) Prior Publication Data

US 2018/0057113 A1 Mar. 1, 2018

Related U.S. Application Data

(60) Provisional application No. 62/378,989, filed on Aug. 24, 2016.

(51) Int. Cl.

| | |
|---|---|
| ***E04H 15/02*** | (2006.01) |
| ***B63B 17/02*** | (2006.01) |
| ***E04H 15/48*** | (2006.01) |
| *B63B 7/00* | (2006.01) |
| *B63B 35/14* | (2006.01) |

(52) U.S. Cl.

CPC ..... *B63B 17/02* (2013.01); *E04H 15/02* (2013.01); *E04H 15/48* (2013.01); *B63B 35/14* (2013.01); *B63B 2007/003* (2013.01); *B63B 2017/026* (2013.01)

(58) Field of Classification Search

CPC ..... E04H 15/02; E04H 15/04; E04H 15/06; E04H 15/46; E04H 15/58; E04H 15/64; E04H 15/54; E04H 15/001; B63B 17/02; B63B 35/14; B63B 35/24; B63B 2035/738; B63B 2017/026; B63B 2007/003

USPC .... 135/90, 96, 121–122, 114, 115, 117, 119, 135/901, 907, 88.05, 88.07; 114/364, 114/361; 280/414.1–414.3

See application file for complete search history.

(56) References Cited

U.S. PATENT DOCUMENTS

| | | | | |
|---|---|---|---|---|
| 3,032,046 A | | 5/1962 | Coonradt | |
| 4,683,900 A | * | 8/1987 | Carmichael | B63B 17/02 114/361 |
| 5,044,298 A | | 9/1991 | Pepper et al. | |
| 5,855,088 A | * | 1/1999 | Lee | A01K 91/08 43/21.2 |
| 6,209,477 B1 | | 4/2001 | Biedenweg | |
| 6,381,897 B1 | * | 5/2002 | Walsh | A01K 97/10 43/21.2 |
| 6,848,387 B1 | | 2/2005 | Zalanka | |

(Continued)

*Primary Examiner* — Winnie Yip

(74) *Attorney, Agent, or Firm* — McHale & Salvin, P.A.

(57) ABSTRACT

A portable canopy for use with a boat having a covered helm and at least two fishing rod holders mounted thereto. The portable canopy employs a first tubular shaped support member having a proximal end securable to a rod holder found on a fishing boat. A second tubular shaped support member having a proximal end is secured to a second rod holder, adjacent to, but spaced apart from, the first support member. The first and second support members are secured to the rod holders by use of locking pins. A spreader bar is attached to the distal end of each said support member, forming a rigid frame between the support members and the rod holders. A fabric cover extends between the support members, providing shade to the occupants beneath the canopy.

8 Claims, 4 Drawing Sheets

(56) References Cited

U.S. PATENT DOCUMENTS

| | | | | |
|---|---|---|---|---|
| 6,968,800 | B1 * | 11/2005 | Becht | B63B 17/00 114/361 |
| 6,983,716 | B1 | 1/2006 | Ankney et al. | |
| 7,395,774 | B2 | 7/2008 | Borges et al. | |
| 7,895,964 | B2 * | 3/2011 | Russikoff | B63B 17/02 114/361 |
| 8,857,366 | B2 | 10/2014 | Russikoff | |
| 8,997,770 | B1 * | 4/2015 | Martin | A47C 7/66 135/117 |
| 9,194,152 | B1 | 11/2015 | Plasencia | |
| 9,451,830 | B1 * | 9/2016 | Buzzella | A47C 7/66 |
| 9,725,136 | B1 * | 8/2017 | Silva | B63B 17/02 |
| 9,849,940 | B2 * | 12/2017 | Greer | B63B 17/02 |
| 2015/0069204 | A1 * | 3/2015 | Daniels | H01Q 1/34 248/516 |
| 2015/0122169 | A1 * | 5/2015 | Russikoff | B63B 17/02 114/361 |
| 2015/0282626 | A1 * | 10/2015 | Rowe, Jr. | A47C 7/66 135/96 |

* cited by examiner

PORTABLE CANOPY COVER FOR FISHING BOATS

CROSS REFERENCE TO RELATED APPLICATION

In accordance with 37 C.F.R. 1.76, a claim of priority is included in an Application Data Sheet filed concurrently herewith. Accordingly, the present invention claims priority to U.S. Provisional Patent Application No. 62/378,989 entitled "PORTABLE CANOPY COVER FOR FISHING BOATS", filed Aug. 24, 2016. The contents of which the above referenced application is incorporated herein by reference.

FIELD OF THE INVENTION

The present invention relates to shade covers for boats and, in particular, to a portable shade cover for fishing boats having a hard top with rod holders.

BACKGROUND OF THE INVENTION

The need to protect an individual's skin from the sun is well understood. This is especially important while boating since the cooling effects of water may mask the otherwise intense temperature of direct sunlight. Further, Ultraviolet A and Ultraviolet B radiation in sunshine can weaken the dermis of the skin, which can result in wrinkles, brown spots, and the development of skin cancer. The intense sunlight in Florida is known to cause basal cell carcinoma in the epidermis, squamous cell carcinoma, and melanoma, which can start in the skin's pigment cells, but can spread to other organs.

While most boats have adopted a cover for the occupants, center console boats have grown immensely popular over the years. Unfortunately, center console boats and open fishing boats have limited protection from the sun. In a center console, you walk on a floor with access around a centrally disposed helm; the central helm typically having a sun shade cover over the helm, leaving an open cockpit behind the helm. In a walk-around boat, you step up onto the deck or raised surface in front of the helm, typically with a cover over the helm area. An open cockpit behind the helm allows for ease of fishing. The cockpits are typically designed for fishing, but can be adapted for entertaining by including convertible seating and T-tops.

With the larger cockpits being provided on boats, many individuals choose to be shaded from the sun. In recreational boating, the Bimini top is a cover that is deployed above the heads of the occupants. The cover can be used to extend the coverage of the T-top, or hard top, to protect the occupants from the sun rays. Deployment of these covers is typically performed manually, but may also be power driven, such as those described in U.S. Pat. Nos. 6,209,477 and 6,983,716. Regardless of their specific foldable structure or method of operational deployment, the installation and utilization of bimini tops have become increasingly important for the protection of passengers and crew on board boats against excessive sun exposure and the evident risks of skin cancer caused thereby.

Patents directed to shielding the occupants on a boat from direct sunlight include U.S. Pat. No. 9,194,152 which is directed to a cantilever canopy for extending over a surface. The cantilever canopy includes a first telescoping support member and a second telescoping support member. A telescoping coupling member is secured between the first telescoping support member and second telescoping support member. A first pivot hinge pivotably couples the first telescoping support member with a first telescoping cantilever member. A second pivot hinge pivotably couples the second telescoping support member with a second telescoping cantilever member. A screen extends between the first telescoping cantilever member and the second telescoping cantilever member for providing shelter under the screen.

U.S. Pat. No. 6,848,387 discloses a sun shade adapted to be attached to and carried on a rigid side or end margin of a bimini top, T-top and the like for a boat. The sunshade includes an elongated shade panel formed of substantially opaque material and pivotal connectors on one longitudinal margin of the shade panel adapted for attachment to, and selected pivotal movement of, the shade panel with respect to the side or end margin of the Bimini top or T-top. The shade panel is thereby selectively pivotally moveable about a pivotal axis passing through the pivotal connectors between a deployed or outstretched downwardly extending position with respect to the bimini top or T-top, wherein low-to-the-horizon sun is substantially blocked from a boat operator's or passenger's eyes and a stored position doubled over and positioned against a corresponding side or end portion of the bimini top or T-top.

U.S. Pat. No. 5,044,298 discloses a boat canopy operable in a first mode, wherein the canopy is spaced a first distance above the deck, and a second mode, wherein the canopy is spaced a second distance less than the first distance above the deck, wherein the canopy permits an operator to be positioned at the helm.

U.S. Pat. No. 3,032,046 relates to a portable and collapsible awning for use on boats. The primary object of the invention is to provide a more practical, efficient, and serviceable device of the kind indicated, which can be made of lightweight material, such as tubing, in a rigid and rugged form, and which collapses and folds to a compact bundle for easy carrying and storing; and which, when installed on a boat, is easily adjustable to provide shade in different areas adjacent to its mounting.

U.S. Pat. No. 7,395,774 relates to a retractable canopy structure adapted to be used in conjunction with the canopy structure on a boat's existing T-top tubular frame near the level of the existing canopy. The canopy frame structure comprises two longitudinally aligned, telescoping members with at least one transverse, telescoping frame member disposed between the two longitudinal members to prevent the canopy from collapsing when under tension. The canopy frame structure is disposed onto the existing T-top frame using a mounting assembly comprising a grommet adapted to be placed between two frame members and wrapped with an adjustable strap. The canopy and telescoping frame components are designed to be adaptable to various T-top canopy widths, and can be extended to various lengths to increase the amount of available canopy shade area while in the mounted position on the boat's existing T-top.

U.S. Pat. No. 8,857,366 discloses a manually-operated canopy deployment system for mounted attachment onboard recreational boats which comprises a pair of spring-loaded tubular actuators telescopically assembled and coupled in parallel alignment to deploy a flexible canvas from a roller member transversely mounted between the actuators with a gear box operatively connected to the roller member to control the canvas deployment. Each actuator assembly includes a rearward outer tube, and separate forward and intermediate interior tubes, each fitted with inner end caps and coaxially disposed to move longitudinally within the outer tube, with compression springs separately disposed within the respective tube chambers to apply outbound forces axially upon the inner ends of the respective interior tubes. Forward and intermediate cross bars connected across the interior tubes serve to draw the canvas from the roller member and support canvas deployment, with a pair of loop attachments provided on the surface of the canvas to prevent billowing thereof.

SUMMARY OF THE INVENTION

Disclosed is a portable canopy for use with a boat having a covered helm and at least two fishing rod holders mounted thereto. The portable canopy employs a first tubular shaped aluminum support member having a proximal end securable to rod holders commonly found on fishing boats at the rear of the T-top, Bimini top, or hard top. A second tubular shaped support member having a proximal end is secured to a second rod holder adjacent to, but spaced apart from, the first support member. The first and second support members are secured to the rod holders by use of locking pins, and are bent, so as to follow the lines of the boat and present a canopy holder above the cockpit of the boat. A spreader bar is attached to the distal end of each said support member, forming a rigid frame between the support members and the rod holders. One end of the spreader bar is hingedly attached to a support member so that it is readily available to deploy upon installation. The opposite end of the spreader bar is coupled to the second support member by a locking pin. A fabric cover extends between the support members, providing shade to the occupants beneath the canopy. The fabric cover includes hook and loop attachment, allowing the occupants to adjust the canopy for variances in rod holder spacing and fabric condition.

Accordingly, it is a general purpose and object of the present invention to provide a portable canopy top for fishing boat cockpits, wherein rod holders are positioned above the helm of the boat.

Another objective of the invention is to teach a low cost, easy to install canopy that is releasably secured to rod holders.

Yet still another objective of the invention is to teach the use of locking pins for securing support members to rod holders, and to an adjoining support member.

Still another objective of the invention is to provide a sun shading canopy that effectively shades occupants of the cockpit from the sun and drains any accumulating rain water away from the deck of the boat without adversely affecting headroom of the passengers or visibility of the driver.

A still further objective of the present invention is to provide a portable canopy that is capable of improving the functionality and appearance of the boat upon which it is installed.

Yet another objective of the invention is to employ telescoping members that allow for compact storage and allow for variations in fabric sizing.

Other objectives and further advantages and benefits associated with this invention will be apparent to those skilled in the art from the description, examples and claims which follow.

DETAILED DESCRIPTION OF THE PREFERRED EMBODIMENT

Figure 1:
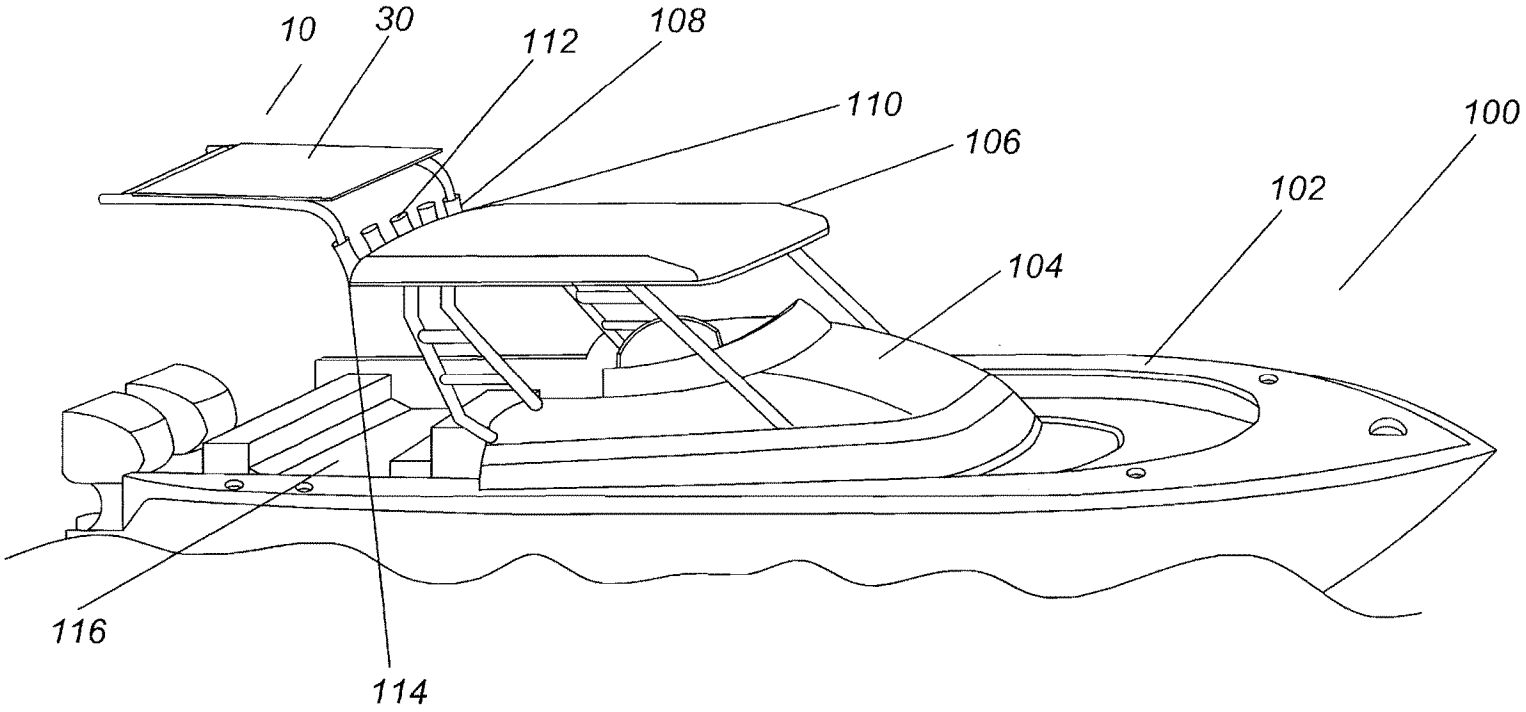
FIG. 1 is a perspective view of the portable canopy cover on the vessel.
Figure 2:
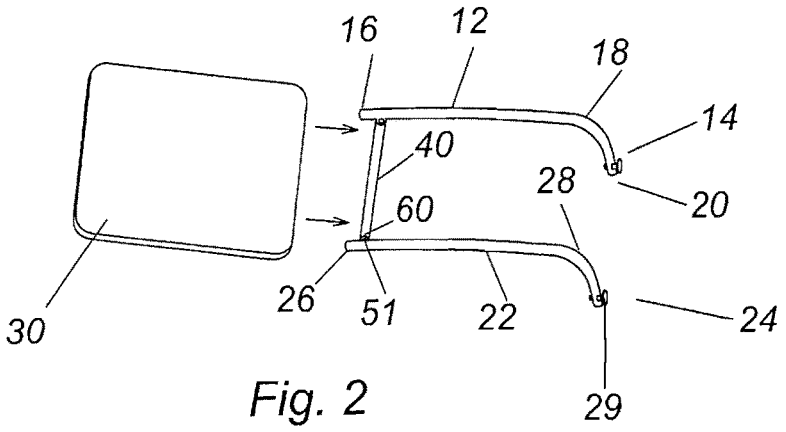
FIG. 2 is an exploded view of the support members and the cover of the instant invention.
Figure 3:
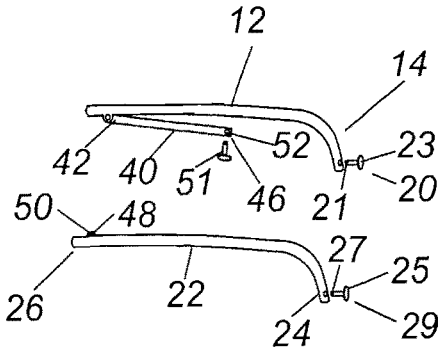
FIG. 3 is a perspective view of the support members and spreader bar.
Figure 4:
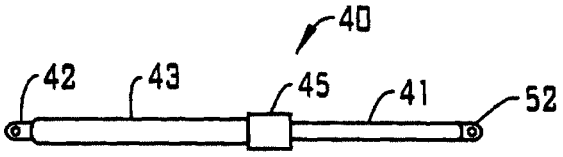
FIG. 4 is a plane view of an telescoping spreader bar.

Detailed embodiments of the instant invention are disclosed herein, however, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

Referring to the Figures in general, set forth is a vessel 100 having a hull 102 with a centrally disposed helm 104 depicted with a T-top 106 mounted thereto. The T-top 106 includes conventional rod holders 108 located along the rear 110 of the T-top 106. The rod holders 108 each have a first open end 112 and a lower open end 114. The portable canopy 10 of the instant invention consists of a first tubular shaped support member 12 having a proximal end 14 and a distal end 16. The support member 12 has a length which is the distance between the proximal end 14 and the distal end 16, and includes an angular bend 18 that allows positioning of a substantial portion of the support member 12 to be on the same horizontal plane as the cockpit 116 of the vessel 100. A first locking pin 20 is located along the proximal end 14 of the first support member 12, and is preferably a conventional locking pin having a pushbutton release 23 to disengage a locking ball 21 on the locking pin. A second tubular shaped support member 22 has a proximal end 24 and distal end 26. Similar to the first tubular shaped support member 12, the second tubular shaped support member 22 includes an angular bend 28 to provide a matching angular positioning of a substantial portion of the support member 22 to equal support member 12 for placement over the cockpit 116 of the vessel 100. A canvas or the like flexible top 30 is placed over support members 12, 22, and a spreader bar 40 positions the distal ends 16 and 26 in a pre-determined spaced apart position.

In a preferred embodiment, the spreader bar 40 is hingedly attached 42 to the distal end 16 of the first support member 12 and is rotated in position, wherein a second end 46 of the spreader bar 40 engages the second tubular shaped support member 22 along the distal end 26, having a boss 48 with aperture 50. In a preferred embodiment the spreader bar 40 is telescoping having a first end 41 that is slidably insertable into a second end 43. Clamp adjuster 45 maintains the first end 41 and second end 43 in a fixed position. The telescoping spreader bar provides a benefit of compact storage, wherein the first end 41 can be placed substantially within the second end 43. Further, the telescoping spreader bar allows for the adjustment of the cover 30 to correct stretching which naturally occurs as the fabric cover ages, as well as allows the use of single element that can be used on various sized assemblies. Spreader bar aperture 52 is aligned with the support member aperture 50 located in the boss 48 for receipt of a locking pin 60. Locking pin 60 is similar to locking pins 20 and 29, wherein mounting apertures have a tolerance to receive a displaceable ball to prevent unwanted removal of the locking pin. The locking pin 60 is used to secure the spreader bar 40 in a fixed spacing position between the first tubular shaped support member 12 and second tubular shaped support member 22. When the flexible canopy 30 is secured to the first and second support members 12 and 22, occupants beneath the canopy are shaded. The simplicity of the design makes the sun shade easy to manufacture, store and install. It should be noted that the locking pin 29 is similar to locking pin 20, namely having a push button release 25 for locking tab 27.

Figure 5:
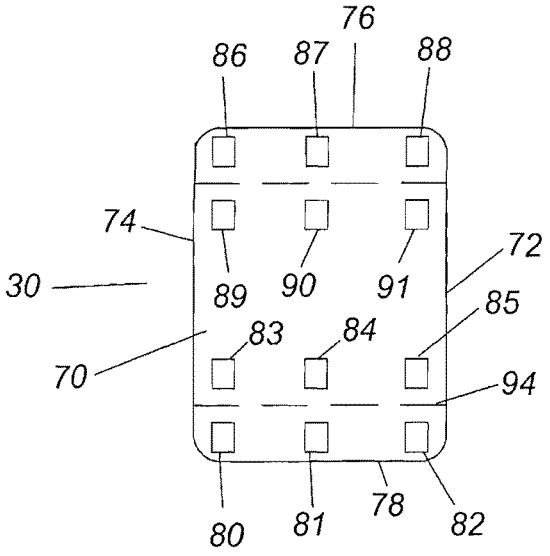
FIG. 5 is a plane view of the bottom of the canopy cover.
Figure 6:
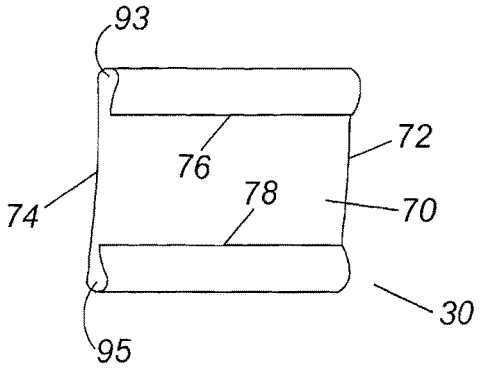
FIG. 6 is a plane view of the canopy cover of FIG. 5 in the folded position

To secure installation, the proximal ends 14 and 24 are placed through rod holders 108 as depicted in FIG. 1, by extending the leading edge of each proximal end through the upper end 112 of the rod holder slightly to a point past the lower end 114, wherein locking pins 20 and 29 secure the support members 12 and 22 from dislodgement should the vessel encounter high seas. The shape of the proximal ends 14 and 24 are configured to fit within the rod holders with the leading edges projecting through the bottoms of the rod holders. In one embodiment, depicted in FIGS. 5 and 6, the cover 30 is preferably made from a rectangular piece of material having "Velcro" hook and loop pieces. The beneath section 70 of the cover 30 has a front edge 72, rear edge 74, and side edges 76 and 78. Hook patches 80, 81 and 82 are along edge 78, and are securable to loop patches 83, 84 and 85, respectively. Similarly, along edge 76, hook patches 86, 87 and 88 are available for attachment to loop patches 89, 90 and 91, respectively. In this manner, the bottom 70 is placed over the support members with the first support member 12 positioned along alignment line 92, wherein hook patches 86, 87 and 88 are attached to loop patches 89, 90 and 91, creating a cylindrical enclosure 93 for securement to the support member. Similarly, second support member 22 is placed along alignment line 94 with hook patches 80, 81 and 82 wrapped around the support member 22 to engage loop patches 83, 84 and 85, respectively, creating a cylindrical holding section 95 for securement to the second support member 22. The use of hook and loop attachment allows for ease of adjustment as the canopy stretches due to age, or for adjustment when the rod holders are not spaced in accordance with a pre-determined position. The use of hook and loop further allows a wider range of adaptation to different rod holder placements. It should be noted that sizing of the rod holders and spreader bar would eliminate the need for hook and loop attachment, and allow the edges 76 and 78 to be sewn directly to the cover for further ease in manufacturing or custom fit applications.

Figure 7:
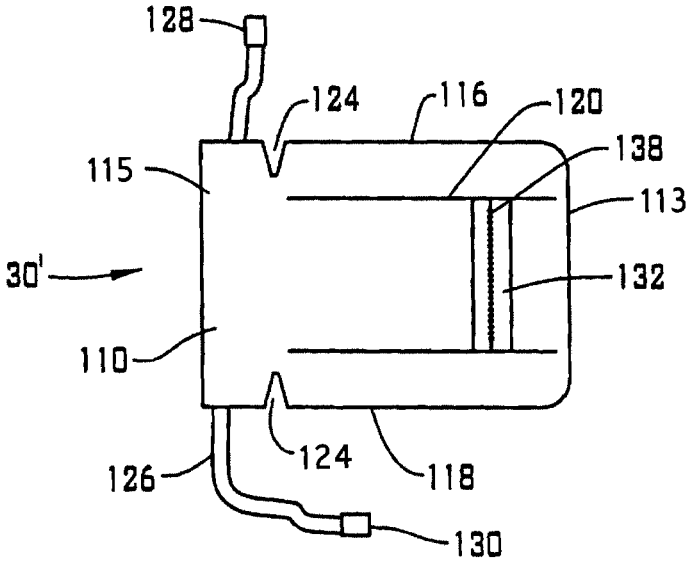
FIG. 7 is a plane view of the bottom of the canopy cover having a zipper pocket for the spreader bar.
Figure 8:
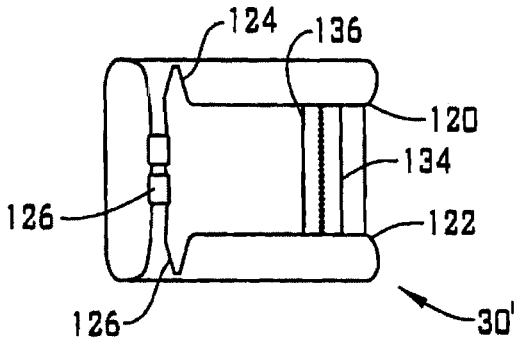
FIG. 8 is a plane view of the canopy cover of FIG. 7 in the folded position.

In an alternative embodiment, depicted in FIGS. 7 and 8, the cover 30' is made from a rectangular piece of material. The beneath section 110 of the cover 30' has a front edge 113, rear edge 115, and side edges 116 and 118. Side edge 116 is sewn and/or welded along seam 120. Side edge 118 is sewn and/or welded along seam 122. Upon installation, the support members 12 and 22 are inserted into the cylindrical enclosure formed by the material attachment. Rear edge 115 includes a material break 124 which allows the material to adjustably folded around the angular bend 18 of support member 12 and angular bend 28 of support member 22. An adjustable strap 126 includes a male connector 128 secureable to a female connector 130. The adjustable strap 126 can be made out of nylon or the like material, and allows the rear edge 115 to be adjusted to accommodate material size differences. A zippered pocket 132 is positioned near the front edge 113 of the cover 30' consisting of a first panel 134 having a base edge secured to the cover and a second panel 136 having a base edge secured to the cover. A zipper 138 is placed along an extended edge adjoining the first and second panel wherein the spreader bar 40 can be concealed within a pocket formed between the panels and the cover.

Disassembly can be quickly accomplished by removing the pin 51 from the spreader bar and sliding the cover 30 off the first and second support members 12 and 22. The support members 12 and 22 can then be released from the rod holders 108 by disengagement of locking pins 20 and 29, and all items can be easily stored in a bag for re-use. In a preferred embodiment, the support members are made from anodized aluminum and the canopy can be made of most any flexible material currently used for boat covers, including canvas, as well as polyester, nylon, and well known specialty materials, such as Sunbrella, which are specifically treated to resist UV degradation and moisture rot degradation.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a device that "comprises," "has," "includes" or "contains" one or more steps or elements, possesses those one or more steps or elements, but is not limited to possessing only those one or more elements.

All patents and publications mentioned in this specification are indicative of the levels of those skilled in the art to which the invention pertains. It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A portable canopy for use with a boat having a helm covered with a T-top and at least two angular positioned fishing rod holders mounted along the rear corners of the T-top, said portable canopy comprising:

a first tubular shaped single piece rigid support member having a proximal end and a distal end defining a length therebetween, said proximal end constructed and arranged to be releasably secured to a first fishing rod holder, said proximal end extending through an upper end of a first rod holder and past a lower end, said first support member including a first angular bend to position a substantial portion of said first support member in a similar horizontal plane;

a first locking pin securable to said proximal end of said first support member at a position beneath said first lower end, said first locking pin securing said first support member to said first fishing rod holder by preventing said first support member from removal from said first fishing rod holder;

a second tubular shaped single piece rigid support member having a proximal end and a distal end defining a length therebetween, said proximal end constructed and arranged to be releasably secured to a second fishing rod holder, said proximal end extending through an upper end of a second rod holder through a lower end, said second support member spaced apart from said first fishing rod holder, said second support member including a second angular bend to position a substantial portion of said second support member in a horizontal plane;

a second locking pin securable to said proximal end of said second support member at a position beneath said lower end of said second rod holder, said second locking pin securing said second support member to said second fishing rod holder by preventing said second support member from removal from said second fishing rod holder;

a spreader bar hingedly attached to said distal end of said first support member and releaseably secured to the distal end of said second support member, said spreader bar is telescoping having a first end slidably insertable into a second end with a clamp adjuster maintaining said first end in a fixed position to said second end positioning said first support member distal end at a fixed distance from said second support member distal end;

a fabric cover extending between said first angular bend and said first distal end of said first support member, and said second angular bend and said second distal end of said second support member.

2. The portable canopy for use with a boat having a helm covered with a T-top according to claim 1 wherein said fabric cover is attached to said first and second support members to form a tubular shaped pocket by use of a hook and loop fastener.

3. The portable canopy for use with a boat having a helm covered with a T-top according to claim 1 wherein a portion of said fabric cover is sewn together to form a tubular shaped pocket, wherein said tubular shape is constructed and arranged to fit over a portion of said first and second support members.

4. The portable canopy for use with a boat having a helm covered with a T-top according to claim 1 wherein a portion of said fabric cover is welded together to form a tubular shape, wherein said tubular shaped pocket is constructed and arranged to fit over a portion of said first and second support members.

5. The portable canopy for use with a boat having a helm covered with a T-top according to claim 1 wherein said spreader bar is releasably secured to said first support member by a locking pin.

6. The portable canopy for use with a boat having a helm covered with a T-top according to claim 1 wherein said spreader bar first end is hingedly secured to said first support member and said spreader bar second end is releasably secured to said second support member by a locking pin insertable through an aperture on said spreader bar second end for attachment to a boss mounted on said second support member.

7. The portable canopy for use with a boat having a helm covered with a T-top according to claim 6 wherein said locking pin is interchangeable with said first or said second locking pin.

8. The portable canopy for use with a boat having a helm covered with a T-top according to claim 1 wherein said cover includes a zippered pocket constructed and arranged to conceal said spreader bar.

* * * * *